US010030649B2

(12) United States Patent
Ukai et al.

(10) Patent No.: US 10,030,649 B2
(45) Date of Patent: Jul. 24, 2018

(54) HIGH-PRESSURE PUMP

(71) Applicant: DENSO CORPORATION, Kariya-city, Aichi-pref. (JP)

(72) Inventors: Hideaki Ukai, Chiryu (JP); Eiji Itoh, Anjo (JP); Hiroshi Inoue, Anjo (JP)

(73) Assignee: DENSO CORPORATION, Kariya (JP)

( * ) Notice: Subject to any disclaimer, the term of this patent is extended or adjusted under 35 U.S.C. 154(b) by 598 days.

(21) Appl. No.: 14/539,329

(22) Filed: Nov. 12, 2014

(65) Prior Publication Data

US 2015/0132166 A1 May 14, 2015

(30) Foreign Application Priority Data

Nov. 12, 2013 (JP) ..... 2013-233870

(51) Int. Cl.

| | |
|---|---|
| ***F04B 53/08*** | (2006.01) |
| ***F02M 63/02*** | (2006.01) |
| ***F02M 59/44*** | (2006.01) |
| ***F04B 53/04*** | (2006.01) |
| *F02M 37/00* | (2006.01) |
| *F02M 31/20* | (2006.01) |

(52) U.S. Cl.

CPC ..... *F04B 53/08* (2013.01); *F02M 59/442* (2013.01); *F02M 63/0265* (2013.01); *F04B 53/04* (2013.01); *F02M 31/20* (2013.01); *F02M 37/0052* (2013.01)

(58) Field of Classification Search

None

See application file for complete search history.

(56) References Cited

U.S. PATENT DOCUMENTS

| | | | | |
|---|---|---|---|---|
| 6,009,859 | A | 1/2000 | Roche et al. | |
| 2002/0189589 | A1* | 12/2002 | Kato | F02M 21/08 123/458 |
| 2006/0159555 | A1 | 7/2006 | Inoue | |
| 2008/0289713 | A1* | 11/2008 | Munakata | F02M 55/04 138/26 |
| 2009/0097997 | A1 | 4/2009 | Suzuki et al. | |

(Continued)

FOREIGN PATENT DOCUMENTS

| | | |
|---|---|---|
| JP | 9-303227 | 11/1997 |
| JP | 3295678 | 4/2002 |

(Continued)

*Primary Examiner* — Kenneth J Hansen

(74) *Attorney, Agent, or Firm* — Nixon & Vanderhye P.C.

(57) ABSTRACT

A high-pressure pump includes a plunger, a cylinder, a pressuring chamber, a pump body, a main fuel chamber, an auxiliary fuel chamber and a return passage. The cylinder slidably houses the plunger therein. The pump body houses the cylinder and has an end surface on an opposite side of the pump body relative to the pressurizing chamber in an axial direction. The main fuel chamber is in the pump body. The auxiliary fuel chamber has a side defined by one end of the cylinder on an opposite side of the cylinder relative to the pressurizing chamber. The return passage is inside the pump body and is in fluid communication with an external cooling unit. Fuel leaking out from the pressurizing chamber through a clearance between the cylinder and the plunger is collected inside the auxiliary fuel chamber, and the collected fuel flows toward the external cooling unit through the return passage.

11 Claims, 14 Drawing Sheets

(56) References Cited

U.S. PATENT DOCUMENTS

| | | | | |
|---|---|---|---|---|
| 2010/0047086 | A1 | 2/2010 | Suzuki et al. | |
| 2011/0247488 | A1* | 10/2011 | Oikawa ..... | F02M 59/44<br>92/144 |
| 2012/0312278 | A1 | 12/2012 | Usui et al. | |

FOREIGN PATENT DOCUMENTS

| | | |
|---|---|---|
| JP | 2008-19771 | 1/2008 |
| JP | 2008-25481 | 2/2008 |
| JP | 2009-156093 | 7/2009 |
| JP | 2012-122416 | 6/2012 |

* cited by examiner

FIRST MODIFICATION

SECOND MODIFICATION

THIRD MODIFICATION

FOURTH MODIFICATION

FIFTH MODIFICATION

SIXTH MODIFICATION

SEVENTH MODIFICATION

EIGHTH MODIFICATION

HIGH-PRESSURE PUMP

CROSS REFERENCE TO RELATED APPLICATION

This application is based on and incorporates herein by reference Japanese Patent Application No. 2013-233870 filed on Nov. 12, 2013.

TECHNICAL FIELD

The present disclosure relates to a high-pressure pump used in an engine.

BACKGROUND

In recent years, in a viewpoint of resource saving efficiency, direct-injection engines having superior fuel efficiency have been attracting attention. It is necessary for the direct-injection engine to inject high-pressure fuel from an injector. In the related art, a high-pressure pump is known in which a plunger reciprocates inside an inner wall surface of a cylinder so as to suction fuel supplied from a low-pressure pump installed in a fuel tank, to pressurize the fuel in a pressurizing chamber, and to pump the fuel to the injector side.

In the high-pressure pump, the fuel leaking out from the pressurizing chamber to a non-pressurizing chamber side through a clearance between the cylinder and the plunger has a high temperature due to heat generation. In general, an end of the plunger away from the pressurizing chamber is arranged near an engine and is likely to receive heat from the engine.

If a temperature of the high-pressure pump increases, there is a possibility that vapor lock or seizure of a plunger slide portion occurs inside the high-pressure pump. For example, a fuel supply device disclosed in Patent Literature (JP 3295678 B) as a countermeasure thereof suppresses an increase in the temperature of the high-pressure pump by introducing low-temperature fuel supplied through a cooling fuel passage diverging from a fuel supply passage into a cooling chamber inside the high-pressure pump.

SUMMARY

According to the findings by the applicant, in the fuel supply device disclosed in the Patent Literature, it is necessary to supply a large amount of the low-temperature fuel to the cooling chamber of the high-pressure pump, thereby causing a problem in that a load of the low-pressure pump increases. If the pressure applied by the high-pressure pump is increased beyond the pressure in the related art, it is considered that the temperature of the fuel leaking out from the pressurizing chamber through the clearance between the cylinder and the plunger is more considerably increased. Therefore, a method in the related art has a possibility that high-temperature fuel cannot be sufficiently and effectively cooled.

It is an objective of the present disclosure to provide a high-pressure pump which can effectively cool high-temperature fuel leaking out from a pressurizing chamber through a clearance between a cylinder and a plunger.

In a first aspect of the present disclosure, a high-pressure pump includes a plunger, a cylinder, a pressuring chamber, a pump body, a main fuel chamber, an auxiliary fuel chamber and a return passage. The cylinder slidably houses the plunger therein. The pressurizing chamber is formed inside the cylinder and fuel is pressurized inside the pressurizing chamber by sliding movement of the plunger. The pump body houses the cylinder and has an end surface on an opposite side of the pump body relative to the pressurizing chamber in an axial direction. The main fuel chamber is disposed inside the pump body into which fuel is supplied from a fuel inlet that is upstream of the pressurizing chamber. The auxiliary fuel chamber has a side defined by one end of the cylinder on an opposite side of the cylinder relative to the pressurizing chamber. The return passage is disposed inside the pump body and has an opening disposed on the end surface of the pump body. The return passage is in fluid communication with an external cooling unit. Fuel leaking out from the pressurizing chamber through a clearance between the cylinder and the plunger is collected inside the auxiliary fuel chamber, and the collected fuel flows toward the external cooling unit through the return passage.

According to the first aspect of the present disclosure, the high-temperature fuel leaking out from the pressurizing chamber through the clearance between the cylinder and the plunger is fed from the auxiliary fuel chamber to the external cooling unit through the return passage. The fuel cooled by the cooling unit may be returned to a fuel tank, for example, or may be merged into a low-pressure fuel passage disposed from the low-pressure pump to the high-pressure pump. In this manner, by feeding the high-temperature fuel to the external cooling unit, it is possible to prevent vapor lock or seizure of a plunger slide portion from occurring inside the high-pressure pump due to the high-temperature fuel.

In a second aspect of the present disclosure, the high-pressure pump may include fuel a bottom cover member fixed to the pump body and having a bottom surface that faces the end surface of the pump body, and a communication passage forming plate that is interposed between the end surface of the pump body and the bottom cover member. The communication passage forming plate may have a return communication passage therein that fluidly communicates the auxiliary fuel chamber with the return passage in a radial direction. In this case, for example, as compared to a case of processing a communication groove on the end surface of the pump body, the number of processing steps can be reduced. Component costs can be reduced by manufacturing the communication passage forming plate by means of press molding.

In a third aspect of the present disclosure, a communication passage may be disposed inside the pump body and fluidly connecting the main fuel chamber and the auxiliary fuel chamber. In this case, the fuel of the auxiliary fuel chamber can be cooled by supplying the low-temperature fuel from the main fuel chamber into the auxiliary fuel chamber through the communication path.

The return passage and the communication passage may be circumferentially separated each other. For example, when the return passage and the communication passage are opposite to each other across the plunger, the fuel flowing into the auxiliary fuel chamber from the communication passage is directed toward the return passage formed at the opposing position without changing a flowing direction. Therefore, resistance in the fuel flow is lessened, thereby allowing smoother flow. Alternatively, the communication passage may branch off from an intermediate portion of the return passage.

In a fourth aspect of the present disclosure, a first check valve and a second check valve may be disposed in the communication passage. The first check valve allows fuel flow from the main fuel chamber to the auxiliary fuel chamber, and prohibits fuel flow from the auxiliary fuel chamber to the main fuel chamber. The second check valve allows fuel flow from the auxiliary chamber to an outside of the pump body, and prohibits fuel flow from the outside to the auxiliary fuel chamber. In this case, a flowing direction of the fuel in the communication passage and the return passage is regulated so that the fuel flows in one direction.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
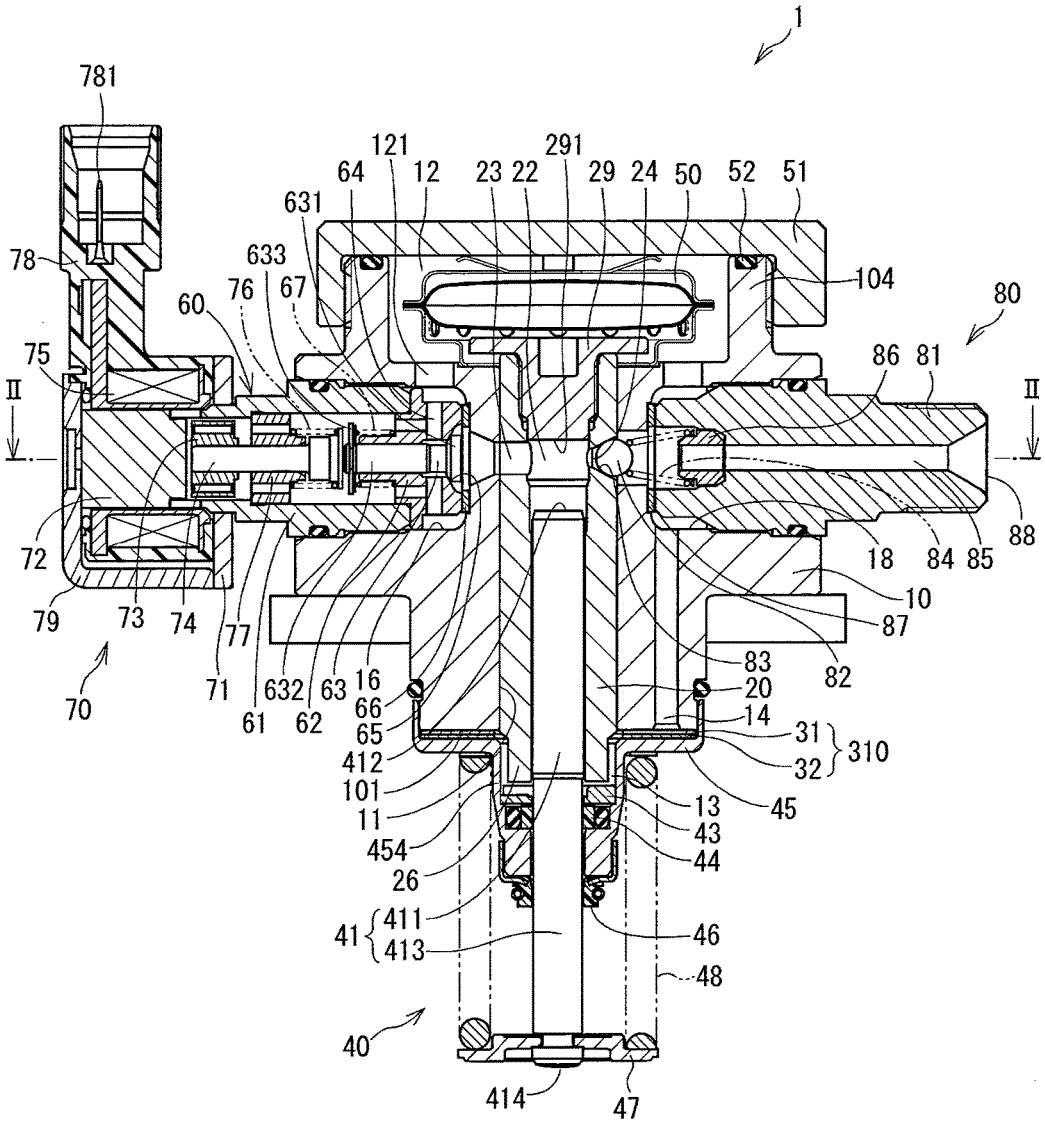
FIG. 1 is a cross-sectional view (cross-sectional view taken along line I-O-I in FIG. 2) of a high-pressure pump according to a first embodiment of the present disclosure.

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A high-pressure pump according to a first embodiment of the present disclosure will be described with reference to FIGS. 1 to 8.

First, description will be made with reference to FIGS. 7 and 8 which illustrate an overall configuration of a fuel supply system to which the high-pressure pump is applied. In fuel supply systems 901 and 902 mounted on a vehicle, fuel inside a fuel tank 91 is supplied to a high-pressure pump 1 through a low-pressure fuel passage 951 by a low-pressure pump 92 as illustrated by solid arrows. The high-pressure pump 1 pressurizes the supplied fuel and discharges the fuel to a fuel rail 93 through a high-pressure fuel passage 952. High-pressure fuel of the fuel rail 93 is supplied to a plurality of (for example, four) injectors 94 through an injector passage 953, and is injected into a cylinder of an engine (not illustrated) or an air intake passage.

Figure 2:
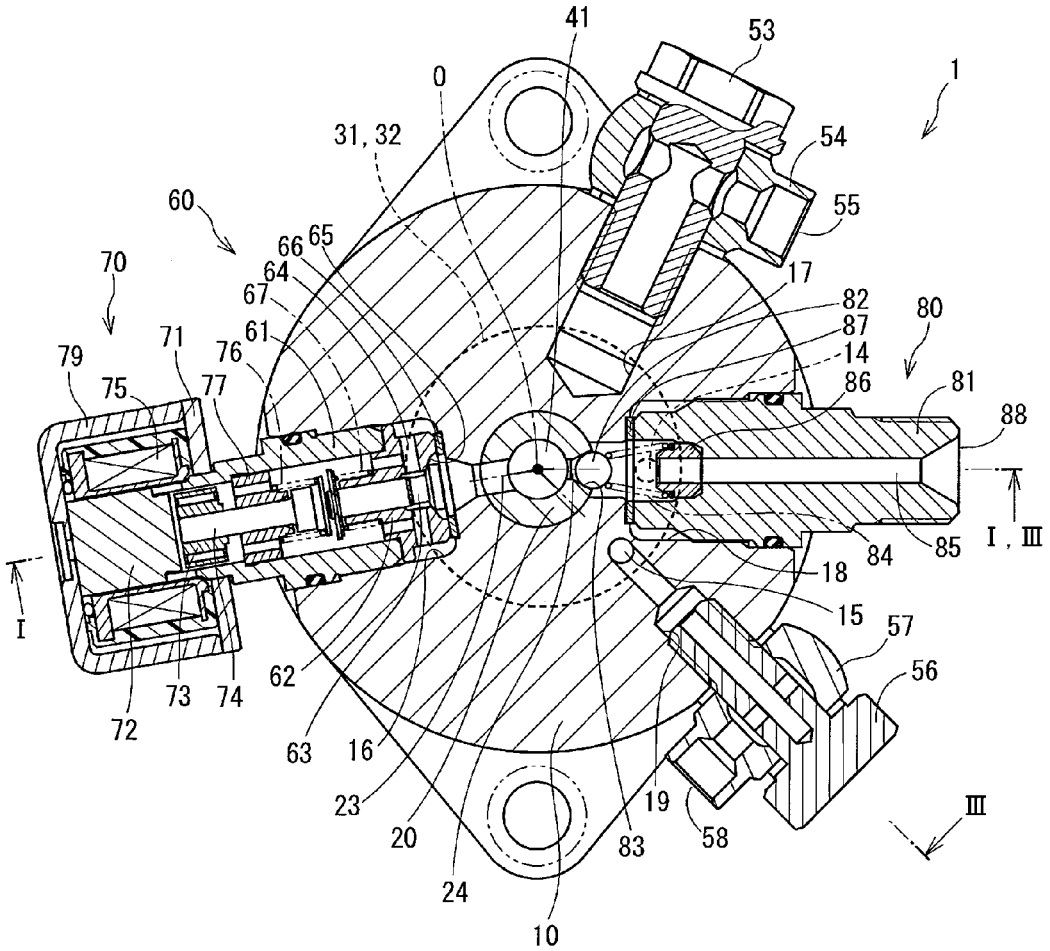
FIG. 2 is a cross-sectional view taken along line II-II in FIG. 1.
Figure 3:
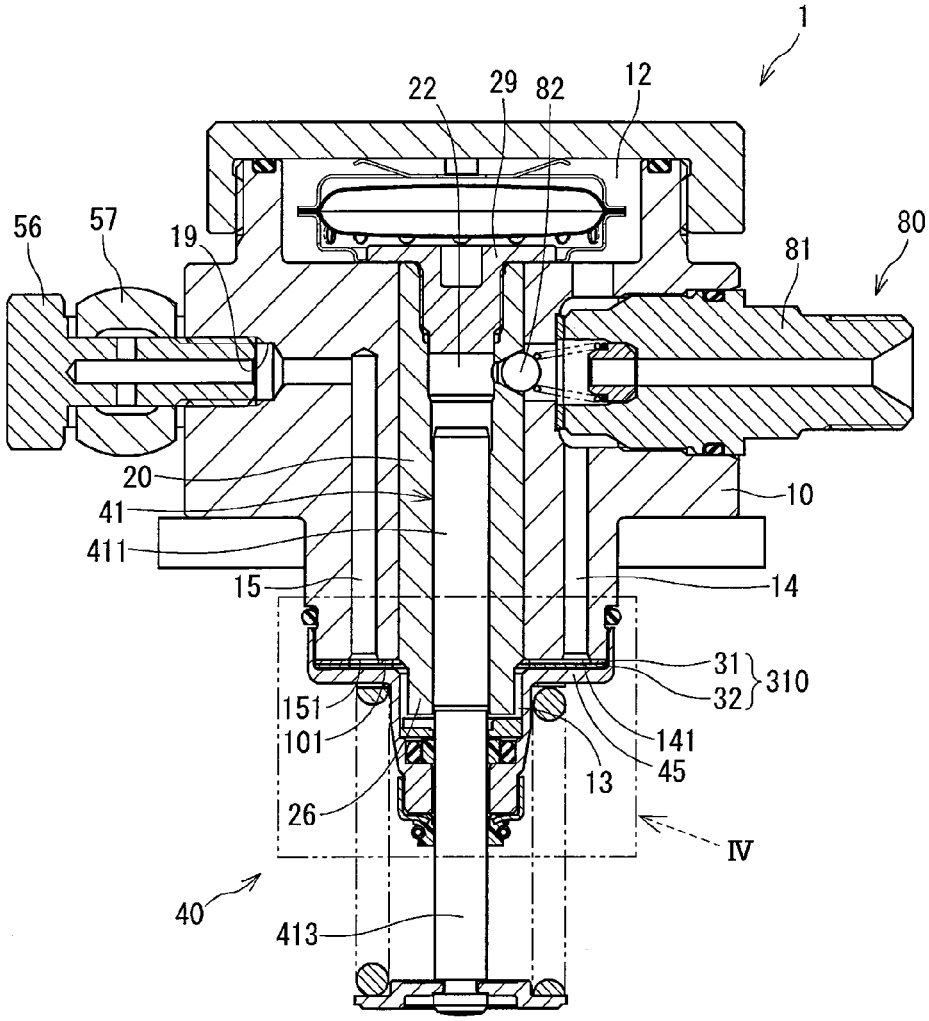
FIG. 3 is a cross-sectional view taken along line III-O-III in FIG. 2.

An overall configuration of the high-pressure pump 1 according to the present embodiment will be described mainly with reference to FIGS. 1 to 4. Hereinafter, for the sake of convenience, an upper side in FIGS. 1 and 3 is referred to as an "upper side" in the description, and a lower side is referred to as a "lower side" in the description.

As illustrated in FIGS. 1 to 4, the high-pressure pump 1 includes a pump body 10, a cylinder 20, a plunger unit 40, a suction valve unit 60, an electromagnetic drive unit 70, and a discharge valve unit 80. Hereinafter, configurations of each unit will be sequentially described.

(Pump Body 10 and Cylinder 20)

The pump body 10 configures an outer shell of the high-pressure pump 1. The plunger unit 40 which is a lower part of the pump body 10 is inserted into an attachment hole of an engine (not illustrated). Power of a cam shaft is transmitted to a plunger 41 via a tappet so as to drive the high-pressure pump 1. Hereinafter, an end surface on an opposite side of the pump body 10 relative to the pressurizing chamber 22 is referred to as a drive side end surface 101. That is, the drive side end surface 101 is the end surface of the pump body 10 close to the plunger unit 40.

The pump body 10 has a cylinder insertion hole 11 penetrating along a center axis O (refer to FIG. 2), a suction valve holder attachment hole 16 and a discharge valve holder attachment hole 18 which are orthogonal to the cylinder insertion hole 11. The cylinder 20 is inserted into the cylinder insertion hole 11. A suction valve holder 61 and a discharge valve holder 81 (which are to be described later) are respectively attached to the suction valve holder attachment hole 16 and the discharge valve holder attachment hole 18. As illustrated in FIG. 2, the suction valve holder attachment hole 16 and the discharge valve holder attachment hole 18 are arranged substantially opposite to each other across the center axis O.

In the present embodiment, a communication passage 14 is formed so as to vertically intersect the discharge valve holder attachment hole 18. The communication passage 14 crosses the pump body 10 in an axial direction, is open to a bottom of a main fuel chamber 12 in an upper part, and is open to the drive side end surface 101 in a lower part.

As illustrated in FIG. 2, an inlet plug hole 17, a return passage 15, and a return plug hole 19 are formed in a direction which is different from that of the suction valve holder attachment hole 16 and the discharge valve holder attachment hole 18. An inlet plug 53 fixes and screws a union 54 to the inlet plug hole 17. In this manner, a fuel supply route which passes through the union 54 and the inlet plug 53 from a fuel inlet 55 and communicates with the inlet plug hole 17 is formed. A pipe of a low-pressure fuel passage 951 (refer to FIGS. 7 and 8) is connected to an upstream side of the fuel inlet 55.

The return passage 15 is disposed inside the pump body 10 and has an opening 151 disposed on the drive side end surface 101 of the pump body 10. As shown in FIG. 2, the return passage 15 and the communication passage 14 are circumferentially separated each other. In the return passage 15, a passage which communicates with the return plug hole 19 and extends in the radial direction (lateral direction in FIG. 3) and a passage which is open on the drive side end surface 101 and extends in the axial direction intersect each other in an L-shape. The return plug 56 fixes and screws the union 57 to the return plug hole 19. In this manner, a fuel discharge route which passes through the return plug 56 and the union 57 from the return passage 15 and communicates with a discharge port 58 is formed.

Here, referring back to FIGS. 7 and 8, description will be continued. A pipe of an external return passage 971 connected to a fuel cooler 96 serving as a "external cooling unit" is connected to the discharge port 58. The return passage 15 is in fluid communication with the fuel cooler 96 through the external return passage 971. As illustrated by dashed arrows, the high-temperature fuel discharged from the return passage 15 is fed to the fuel cooler 96 through the external return passage 971, and is cooled in the fuel cooler 96. In addition, the fuel returning from the fuel rail 93 and the fuel leaking out from the injector 94 respectively flow into the fuel cooler 96 through passages 972 and 973.

Figure 7:
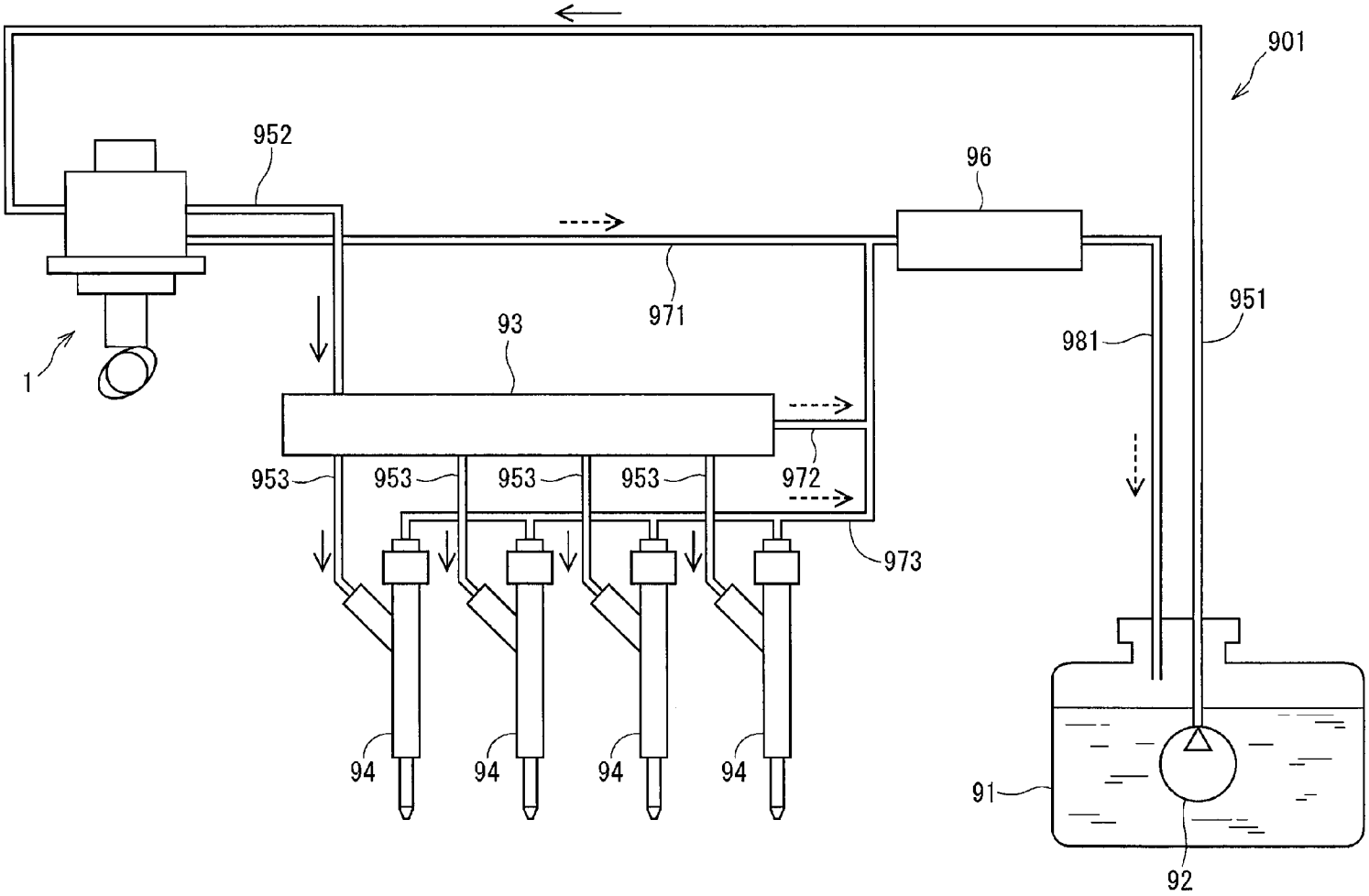
FIG. 7 is an overall configuration diagram illustrating a fuel supply system as an example which adopts the high-pressure pump according to the first embodiment of the present disclosure.
Figure 8:
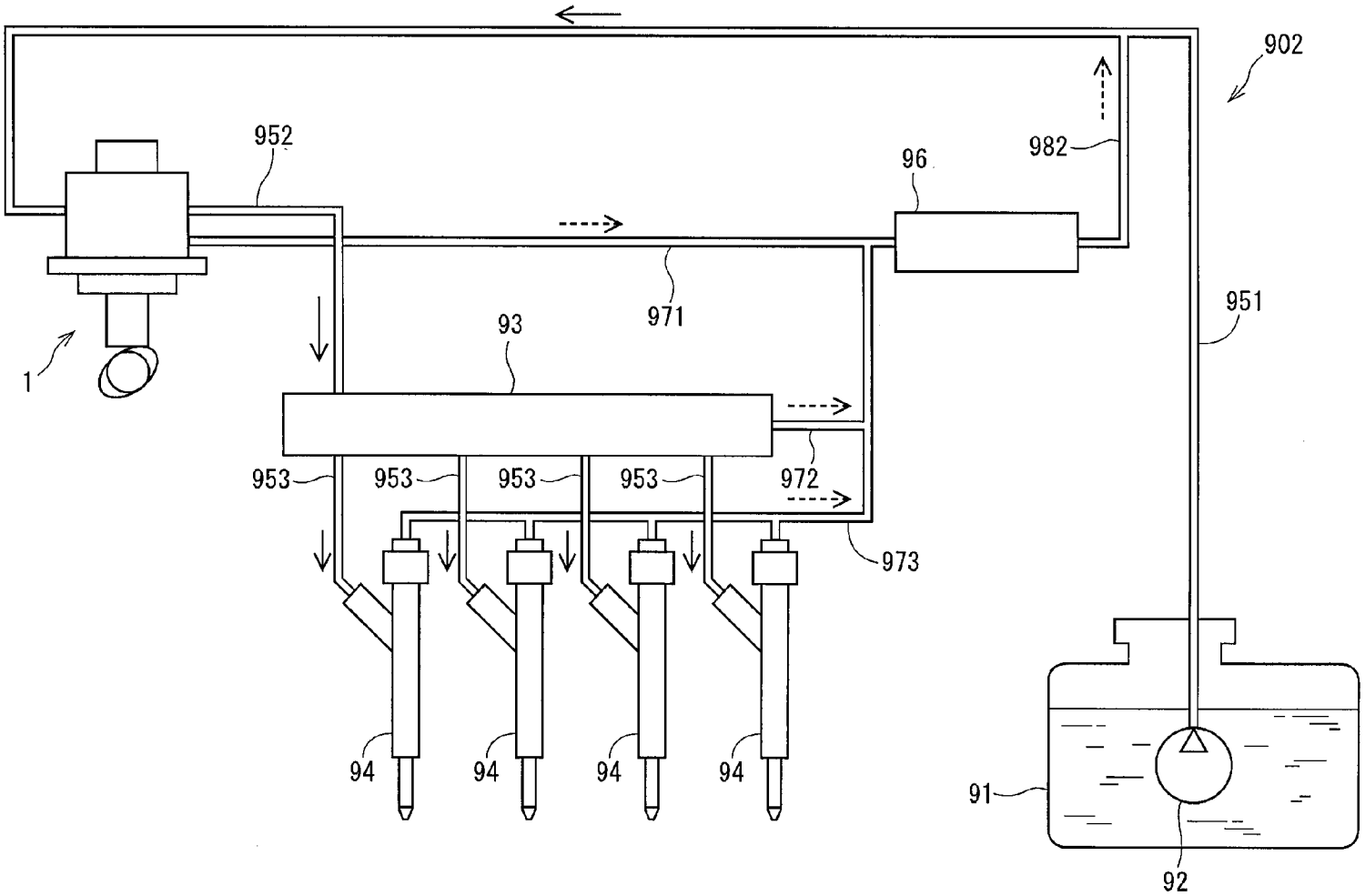
FIG. 8 is an overall configuration diagram illustrating a fuel supply system as another example which adopts the high-pressure pump according to the first embodiment of the present disclosure.

In the fuel supply system 901 illustrated in FIG. 7, the fuel cooled in the fuel cooler 96 returns to the fuel tank 91 through a cooled fuel passage 981. In the fuel supply system 902 illustrated in FIG. 8, the fuel cooled in the fuel cooler 96 merges into the low-pressure fuel passage 951 through a cooled fuel passage 982. In any fuel supply system, the fuel discharged from the return passage 15 of the high-pressure pump 1 is circulated inside the system until the fuel is finally injected into the engine from the injector 94. Therefore, the fuel is effectively used, thereby preventing fuel vapor from being discharged to the atmosphere.

Figure 4:
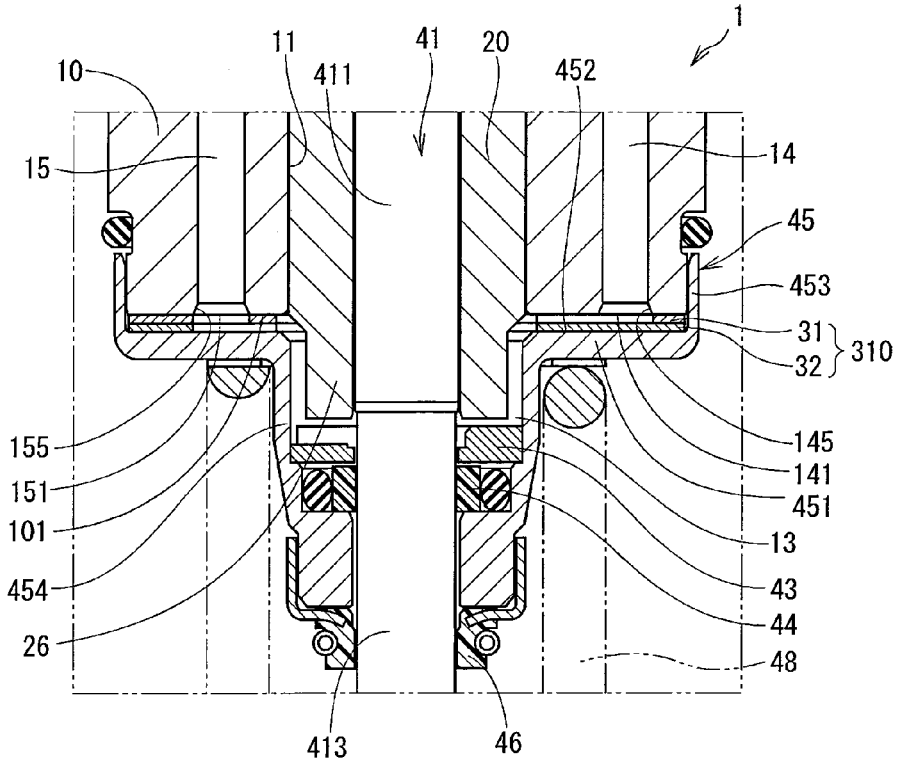
FIG. 4 is an enlarged view of a section IV in FIG. 3.

Description will return to the configuration of the high-pressure pump 1. As illustrated in FIG. 4 which is an enlarged view of a portion in FIG. 3, chamfered portions 145 and 155 (tapered portion) are respectively formed in the communication passage 14 on the drive side end surface 101 and the opening portion of the return passage 15. In the chamfered portions 145 and 155, when focusing on an inner wall on the cylinder 20 side which is a central side of the high-pressure pump 1, the inner wall on the cylinder 20 side is tilted in a direction away from the cylinder 20, that is, toward an outer diameter side of the high-pressure pump 1, as it goes rearward from the opening end surface. In other words, the chamfered portion 155 on a side of the inner wall of the return passage 15 that is closer to the cylinder 20 tapers from the opening 151 of the return passage 15 in a direction away from the cylinder 20, and the chamfered portion 145 on a side of the inner wall of the communication passage 14 that is closer to the cylinder 20 tapers from the opening 141 of the communication passage 14 in a direction away from the cylinder 20.

Next, referring back to FIG. 1, a bottomed cylindrical cover 51 is fastened and fixed to a cylinder wall 104 formed in an upper part of the pump body 10. The main fuel chamber 12 is formed on an inner side between the cylinder wall 104 and the cover 51. An O-ring 52 for sealing the fuel is disposed between an upper end surface of the cylinder wall 104 and the cover 51. The main fuel chamber 12 communicates with the inlet plug hole 17. The fuel is supplied from the fuel inlet 55 upstream of a pressurizing chamber 22 (to be described later).

A pulsation damper 50 in which outer edges of two diaphragms are joined to each other is disposed in the main fuel chamber 12. In the pulsation damper 50, gas having predetermined pressure is kept in a sealed inner side space. Depending on variations in fuel pressure, two diaphragms are elastically deformed in a thickness direction, thereby decreasing fuel pressure pulsation of the main fuel chamber 12.

The cylinder 20 is formed in a cylindrical shape by using heat-treated martensitic-based stainless steel, for example, and is inserted into and fixed to the cylinder insertion hole 11 of the pump body 10 by means of press fitting or shrink fitting. An end portion of the cylinder 20 close to the main fuel chamber 12 is closed in a liquid-tight manner by a plug 29 being screwed into a female threaded portion formed on the inner wall of the cylinder 20. A lower end portion 26 of the cylinder 20 protrudes toward the lower side further from the drive side end surface 101, that is, protrudes in a direction away fro the main fuel chamber 12.

The plunger 41 is slidably housed in the cylinder 20. The pressurizing chamber 22 for pressurizing the fuel is formed between a lower end surface 291 of the plug 29 and a pressurizing end 412 (one end) of the plunger 41. The cylinder 20 has a suction communication hole 23 and a discharge communication hole 24 which respectively communicate with the pressurizing chamber 22 at respective positions corresponding to the suction valve holder attachment hole 16 and the discharge valve holder attachment hole 18 of the pump body 10.

(Plunger Unit 40)

The plunger unit 40 is configured to have the plunger 41, a fuel sealing member 44, an upper seat 45, an oil seal 46, a lower seat 47, and a plunger spring 48.

The plunger 41 of the present embodiment has a stepped shape including a large diameter portion 411 which slides along the inner wall of the cylinder 20 close to the pressurizing chamber 22 in the axial direction and a small diameter portion 413 on an opposite side of the large diameter portion 411 relative to the pressurizing chamber 22. The large diameter portion 411 and the small diameter portion 413 are coaxially aligned with each other. The pressurizing end 412 which is an end portion of the large diameter portion 411 faces the pressurizing chamber 22. In other words, the large pressurizing end 412 defines a side of the pressurizing chamber 22. The lower seat 47 is coupled to a drive end 414 which is an end portion of the small diameter portion 413.

The fuel sealing member 44 is mounted so as to surround a periphery of the small diameter portion 413. The fuel sealing member 44 is configured to have an inner peripheral side Teflon (registered trademark) ring which is in sliding contact with an outer peripheral surface of the small diameter portion 413 and an outer peripheral side O-ring. The fuel sealing member 44 regulates the thickness of a fuel oil film on the periphery of the small diameter portion 413, and suppresses fuel leakage into the engine which is caused by a sliding movement of the plunger 41. In order for the fuel sealing member 44 to function favorably, it is desirable to cool the fuel so that an ambient temperature near the fuel is equal to or lower than a predetermined temperature.

A configuration of an upper portion of the upper seat 45 will be described with reference to FIG. 4. The upper portion of the upper seat 45 has a flange portion 451 which is opposite to the drive side end surface 101 of the pump body 10 and an outer cylindrical portion 453 which extends from an outer edge of the flange portion 451 toward an upper side in the axial direction. The upper seat 45 is fixed to the pump body 10 by the outer cylindrical portion 453 being welded to an outer wall 102 of the pump body 10, for example. Communication passage forming plates 31 and 32 (to be described later) are interposed between the drive side end surface 101 of the pump body 10 and a bottom surface 452 of the flange portion 451. A lower surface of the flange portion 451 of the upper seat 45 supports an upper end of the plunger spring 48.

A middle cylindrical portion 454 which extends axially downward from an inner edge of the flange portion 451 is disposed in a middle portion of the upper seat 45. A space between an inner wall of the middle cylindrical portion 454 and the lower end portion 26 of the cylinder 20 forms an auxiliary fuel chamber 13. In other words, the auxiliary fuel chamber 13 has one side (a side) that is defined by the lower end portion 26 of the cylinder 20, and the other side that is defined by the upper seat 45. Thus, the upper seat 45 defines a boundary on an opposite side of the auxiliary fuel chamber 13 relative to the cylinder 20. The auxiliary fuel chamber 13 collects the fuel leaking out from the pressurizing chamber 22 through a clearance between the cylinder 20 and the plunger 41.

In the auxiliary fuel chamber 13 of the present embodiment, in response to a reciprocal movement of the plunger 41, a volume, which is the product of a difference in a cross-sectional area between the large diameter portion 411 and the small diameter portion 413, and a movement distance of the plunger 41, varies.

In a lower portion of the middle cylindrical portion 454 of the upper seat 45, the fuel sealing member 44 is housed around the small diameter portion 413. Furthermore, the oil seal 46 is mounted on a lower end portion of the upper seat 45 by surrounding the periphery of the small diameter portion 413. The oil seal 46 is in sliding contact with an outer peripheral surface of the small diameter portion 413. The oil seal 46 regulates the thickness of an oil film on the periphery of the small diameter portion 413, and suppresses oil leakage caused by the sliding movement of the plunger 41.

As described above, the upper seat 45 of the present embodiment is a multi-functional member which includes a function for interposing the communication passage forming plates 31 and 32 therebetween, a function for supporting the upper end of the plunger spring 48, a function for defining the boundary of the auxiliary fuel chamber 13, and a function for holding the fuel sealing member 44 and the oil seal 46. Among these functions, in view of the function for interposing the communication passage forming plates 31 and 32 therebetween, the upper seat 45 of the present embodiment corresponds to a "bottom cover member" according to an aspect of the present disclosure.

Subsequently, the lower seat 47 coupled to the drive end 414 of the plunger 41 supports a lower end of the plunger spring 48. The plunger spring 48 in which both ends are locked by the upper seat 45 and the lower seat 47 functions as a return spring of the plunger 41, and biases the plunger 41 against a tappet (not illustrated).

The plunger 41 is brought into contact with a cam of a cam shaft via the tappet by a function of the return spring of the plunger spring 48. In this manner, the plunger 41 performs a reciprocal movement along a profile of the cam shaft, inside the cylinder 20 in the axial direction. The reciprocal movement of the plunger 41 changes the volume of the pressurizing chamber 22, thereby suctioning and pressurizing the fuel.

(Suction Valve Unit 60)

The suction valve unit 60 has the suction valve holder 61, a valve seat member 62, and a suction valve 63.

The suction valve holder 61 is formed in a cylindrical shape, and is fixed to the suction valve holder attachment hole 16 of the pump body 10.

The valve seat member 62 is disposed on a side of the suction valve holder 61 close to the pressurizing chamber 22. The valve seat member 62 has a suction passage 64 in which the fuel supplied from the main fuel chamber 12 through a fuel passage 121 flows into the pressurizing chamber 22, and a valve seat 65 which is formed in an opening on the pressurizing chamber 22 side of the suction passage 64. The valve seat member 62 has a hole which houses a shaft portion 632 of the suction valve 63 so that the shaft portion 632 can perform the reciprocal movement. A sealing member 66 is disposed between the valve seat member 62 and a bottom inner wall of the suction valve holder attachment hole 16.

The suction valve 63 has an umbrella portion 631, a shaft portion 632, and a flange portion 633. The umbrella portion 631 can be seated on the valve seat 65 of the valve seat member 62. The shaft portion 632 is housed in the hole of the valve seat member 62 so that the shaft portion 632 can perform the reciprocal movement. The flange portion 633 is disposed on an opposite side of the shaft portion 632 relative to the umbrella portion 631. A suction valve spring 67 is disposed between the flange portion 633 and the valve seat member 62, and biases the suction valve 63 toward the valve seat 65.

(Electromagnetic Drive Unit 70)

The electromagnetic drive unit 70 has a flange 71, a fixed core 72, a movable core 73, a rod 74, a coil 75, a rod spring 76, and the like.

The flange 71 is fixed to an outer wall of the suction valve holder 61. The movable core 73 is disposed on an inner side of the suction valve holder 61 so that the movable core 73 can perform the reciprocal movement. The rod 74 fixed to the movable core 73 can press the suction valve 63 toward the pressurizing chamber 22. The rod spring 76 biases the movable core 73 and the rod 74 toward the pressurizing chamber 22. A guide member 77 is fixed to the inner side of the suction valve holder 61, and supports the rod 74 so that the rod 74 can perform the reciprocal movement in the axial direction.

The fixed core 72 is disposed on a radially inner side of the coil 75 which is an opposite side of the movable core 73 relative to the pressurizing chamber 22. If the coil 75 is energized through a terminal 781 of a connector 78, a magnetic flux flows in a magnetic circuit defined by the movable core 73, the fixed core 72, a yoke 79, the flange 71, and the like. The movable core 73 and the rod 74 are magnetically drawn toward the fixed core 72 against a biasing force of the rod spring 76.

In contrast, if the coil 75 is not energized, the magnetic flux flowing through the above-described magnetic circuit disappears. Consequently, the movable core 73 and the rod 74 are biased toward the pressurizing chamber 22 by the biasing force of the rod spring 76.

(Discharge Valve Unit 80)

The discharge valve unit 80 has the discharge valve holder 81, a discharge valve 82, a valve seat 83, and a discharge valve spring 84.

The discharge valve holder 81 corresponds to a "discharge passage member" according to an aspect of the present disclosure. The discharge valve holder 81 internally has a discharge passage 85 and is fixed to the discharge valve holder attachment hole 18. A sealing member 87 is disposed between the discharge valve holder 81 and a bottom inner wall of the discharge valve holder attachment hole 18. A spring receiving member 86 is disposed on an inner side of the discharge valve holder 81.

In the present embodiment, in a portion located radially outside an accommodation portion of the spring receiving member 86, an outer wall of the discharge valve holder 81 faces the communication passage 14. In other words, the discharge valve holder 81 has a portion of the outer wall positioned inside the communication passage 14.

The discharge valve 82 is a ball valve, and can be seated on the valve seat 83 formed in a tapered shape on an inner wall of the discharge communication hole 24 of the cylinder 20. The discharge valve spring 84 is formed in a tapered shape whose diameter increases in a direction from the discharge valve 82 toward the spring receiving member 86, and biases the discharge valve 82 against the valve seat 83.

Next, a configuration of the communication passage forming plates 31 and 32 will be described with reference to FIGS. 5A to 5C. The communication passage forming plates 31 and 32 are manufactured by press-molding a steel plate, for example. In the present embodiment, two communication passage forming plates 31 and 32 are superimposed on each other so as to be used as a set of communication passage forming plates 310.

Figure 5A:
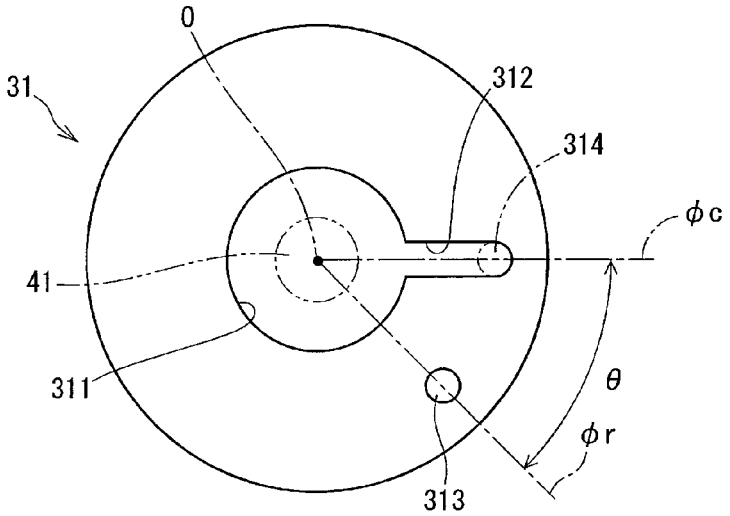
FIG. 5A is a plan view illustrating a communication passage forming plate according to the first embodiment of the present disclosure.

The communication passage forming plate 31 illustrated in FIG. 5A has a connection-communication passage 312 which connects an opening corresponding position 314 corresponding to an opening 141 of the communication passage 14 and a center hole 311, as shown in a right side of the center hole 311 of FIG. 5A. A communication hole 313 corresponding to the opening 151 of the return passage 15 is formed, as shown in a right and lower side section of FIG. 5A. An angle θ formed by a center line φc of the connection-communication passage 312 and a center line φr of the communication hole 313, which pass through the center axis O, is equivalent to an angle formed by the discharge valve holder attachment hole 18 and the return plug hole 19 in FIG. 2.

Figure 5B:
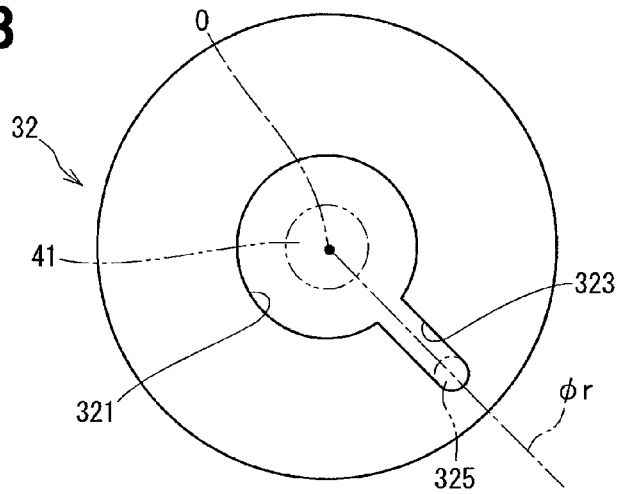
FIG. 5B is a plan view illustrating a communication passage forming plate according to the first embodiment of the present disclosure.

The communication passage forming plate 32 illustrated in FIG. 5B has a return communication passage 323 which connects an opening corresponding position 325 corresponding to the opening 151 of the return passage 15 and a center hole 321, in a right and lower side of the center hole 321 in FIG. 5B.

The center holes 311 and 321 of the communication passage forming plates 31 and 32 allow the lower end portion 26 of the cylinder 20 to be inserted, thereby communicating with the auxiliary fuel chamber 13. Therefore, the return communication passage 323 fluidly communicates the auxiliary fuel chamber 13 with the return passage 15.

Figure 5C:
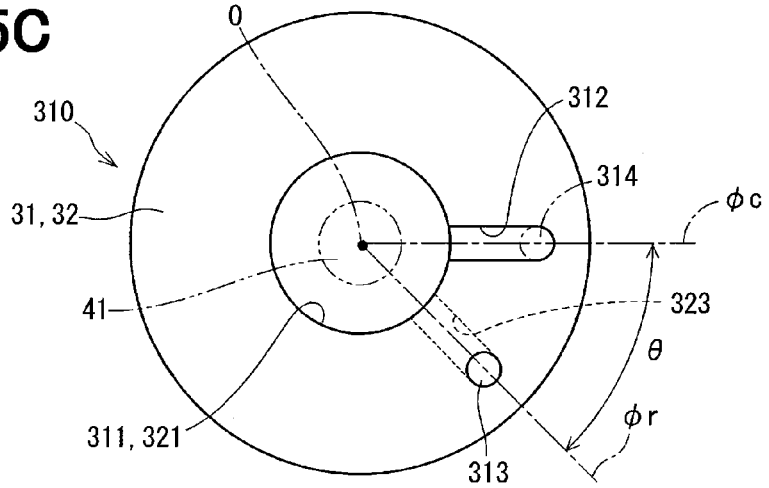
FIG. 5C is a plan view illustrating the communication passage forming plates superimposed on each other according to the first embodiment of the present disclosure.

FIG. 5C illustrates a state where the communication passage forming plates 31 and 32 are superimposed on each other when the communication passage forming plate 31 is located on an upper side of the communication passage forming plate 32. As illustrated in FIG. 4 and the like, the communication passage forming plates 31 and 32 are interposed between the drive side end surface 101 of the pump body 10 and the bottom surface 452 of the flange portion 451 of the upper seat 45. In this manner, positions of the communication passage forming plates 31 and 32 in a rotating direction are regulated. At this time, the communication passage forming plate 31 is arranged close to the pump body 10, and the communication passage forming plate 32 is arranged close to the upper seat 45.

According to this configuration, the fuel of the communication passage 14 flows into the auxiliary fuel chamber 13 through the connection-communication passage 312 and the center holes 311 and 321. The fuel of the auxiliary fuel chamber 13 is discharged to the return passage 15 through the center hole 321, the return communication passage 323, and the communication hole 313.

The set of communication passage forming plates 310 is installed at a portion inside an engine attachment hole. Accordingly, if a large amount of the fuel is collected in the portion, a temperature of the fuel increases due to the heat transferred from the engine, thereby increasing a possibility that vapor may be generated. Therefore, in order to minimize a volume of the fuel collecting portion, it may be preferable to set a size of the connection-communication passage 312 or the return communication passage 323 to the minimum required size.

In the above-described set of double communication passage forming plates 310, a hole shape of the respective communication passage forming plates 31 and 32 is simple, thereby facilitating press molding.

Figure 6:
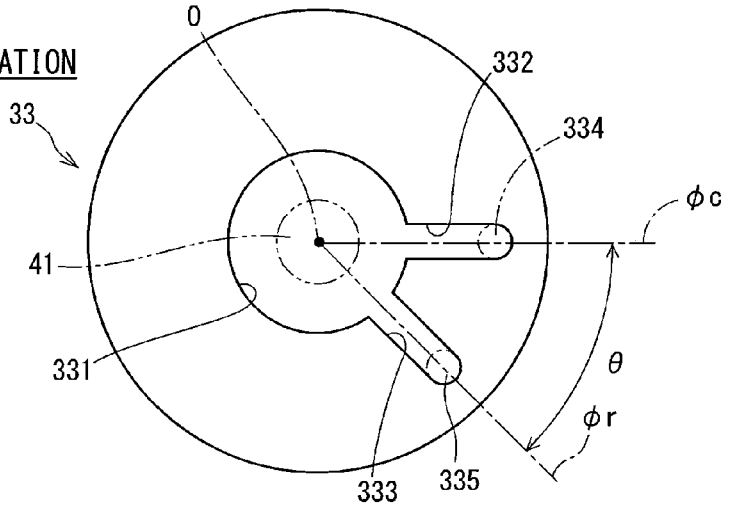
FIG. 6 is a plan view illustrating a single communication passage forming plate according to a first modification of the present disclosure.

In contrast, as a first modification of the first embodiment, a single communication passage forming plate 33 illustrated in FIG. 6 may be adopted. The communication passage forming plate 33 has a connection-communication passage 332 which connects an opening corresponding position 334 of the communication passage 14 and a center hole 331, as shown in the right side of the center hole 331 in FIG. 6. A return communication passage 333 which connects an opening corresponding position 335 of the return passage 15 and the center hole 331 is formed in a direction which forms the angle θ with respect to the connection-communication passage 332. In this manner, the number of components can be reduced.

Next, an operation of the high-pressure pump 1 will be described. In response to the reciprocal movement of the plunger 41, the high-pressure pump 1 repeatedly performs a suction stroke, a metering stroke, and a discharge stroke, and discharges the fuel by pressurizing the fuel in an amount required for the engine. During the process, the fuel leaking out from the pressurizing chamber 22 through a clearance between the cylinder 20 and the plunger 41 becomes hot due to heat generation caused by released pressure, and is collected in the auxiliary fuel chamber 13. In the fuel in the auxiliary fuel chamber 13, the temperature thereof increases due to the heat transferred from the engine.

The present embodiment aims to prevent vapor lock and the like from occurring inside the high-pressure pump 1 due to the high-temperature fuel in the auxiliary fuel chamber 13 as described above. Therefore, hereinafter, a basic operation of the high-pressure pump 1 will be described by focusing on a movement of the high-temperature fuel of the auxiliary fuel chamber 13 particularly in each stroke. As described above, the present embodiment assumes the configuration in which the plunger 41 includes the large diameter portion 411 and the small diameter portion 413 and has the stepped shape.

(1) Suctioning Stroke

If rotation of the cam shaft causes the plunger 41 to descend from a top dead center toward a bottom dead center, the volume of the pressurizing chamber 22 increases, and the pressure of the fuel inside the pressurizing chamber 22 decreases. The discharge valve 82 is seated on the valve seat 83, thereby closing the discharge passage 85. In the suction valve unit 60, a pressure difference between the pressurizing chamber 22 and the suction passage 64 and a biasing force of the rod spring 76 cause the suction valve 63 to move toward the pressurizing chamber 22 against a biasing force of the suction valve spring 67, thereby bringing the suction valve 63 into an opened state. The opening of the suction valve 63 causes the fuel of the main fuel chamber 12 to flow into the pressurizing chamber 22 through the suction passage 64.

During the suction stroke, descending of the plunger 41 decreases the volume of the auxiliary fuel chamber 13, and increases the pressure therein. In response to this change, the high-temperature fuel of the auxiliary fuel chamber 13 is fed to the fuel cooler 96 through the return passage 15.

(2) Metering Stroke

If the rotation of the cam shaft causes the plunger 41 to ascend from the bottom dead center toward the top dead center, the volume of the pressurizing chamber 22 decreases. At this time, the coil 75 is not energized until a predetermined time period elapses. Accordingly, the rod 74 presses the suction valve 63 toward the pressurizing chamber 22 by using a biasing force of the rod spring 76. Thus, the suction valve 63 maintains an opened valve state. Therefore, the low-pressure fuel which was suctioned once into the pressurizing chamber 22 returns to the main fuel chamber 12. Accordingly, the pressure of the pressurizing chamber 22 does not increase.

During the metering stroke, the ascending of the plunger 41 increases the volume of the auxiliary fuel chamber 13, and decreases the pressure therein. A pressure difference occurring between the auxiliary fuel chamber 13 and the main fuel chamber 12 causes the low-temperature fuel of the main fuel chamber 12 to flow into the auxiliary fuel chamber 13 through the communication passage 14, and decreases the fuel temperature in the auxiliary fuel chamber 13. At this time, the low-temperature fuel from the main fuel chamber 12 flows while coming into contact with an outer wall of the discharge valve holder 81. Accordingly, the fuel leaking out from a contact surface of the sealing member 87 is prevented from remaining inside the discharge valve holder attachment hole 18 and increasing the temperature of the discharge passage 85.

(3) Discharge Stroke

If the coil 75 is energized at a predetermined time while the plunger 41 ascends from the bottom dead center toward the top dead center, the magnetic field generated in the coil 75 generates magnetic attraction between the fixed core 72 and the movable core 73. If the magnetic attraction becomes stronger than a difference between the biasing force of the suction valve spring 67 and the biasing force of the rod spring 76, the movable core 73 moves toward the fixed core 72. This movement releases a pressing force of the rod 74 which acts against the suction valve 63.

In this case, the biasing force of the suction valve spring 67 and dynamic pressure of the low-pressure fuel discharged from the pressurizing chamber 22 toward the suction passage 64 cause the suction valve 63 to move in a valve closing direction in response to the operation of the rod 74. Accordingly, the suction valve 63 is seated on the valve seat 65. This operation blocks the pressurizing chamber 22 and the suction passage 64.

After the suction valve 63 is closed, the fuel pressure in the pressurizing chamber 22 increases in response to the ascending of the plunger 41, and the discharge valve 82 is opened. This operation causes the high-pressure fuel pressurized in the pressurizing chamber 22 to be discharged from a fuel outlet 88. In the course of the discharge stroke, the coil 75 is not energized. A force applied to the suction valve 63 by the fuel pressure in the pressurizing chamber 22 is stronger than the biasing force of the rod spring 76. Accordingly, the suction valve 63 maintains the closed state.

As described above, in the high-pressure pump 1 of the present embodiment, the pressure in the auxiliary fuel chamber 13 varies in synchronization with ascending and descending cycles of the plunger 41. In response to this variation, the fuel of the main fuel chamber 12 flows into the auxiliary fuel chamber 13 through the communication passage 14, and the fuel of the auxiliary fuel chamber 13 is discharged toward the fuel cooler 96 through the return passage 15.

Next, effects of the present embodiment will be described.

(1) In the present embodiment, the high-temperature fuel of the auxiliary fuel chamber 13, in which the temperature of the fuel increases due to the heat generation caused by the decreased pressure of the leaking fuel or the heat transferred from the engine, is fed to the fuel cooler 96 through the return passage 15. Therefore, it is possible to prevent vapor lock or seizure of a slide portion of the plunger 41 from occurring inside the high-pressure pump 1 due to the high-temperature fuel.

When the pressurizing pressure in the high-pressure pump is more increased than that in the related art, the heat generation caused by the vanished pressure of the fuel leaking out from the pressurizing chamber 22 through a clearance between the cylinder 20 and the plunger 41 may be further increased. Accordingly, the effects of the present embodiment are more conspicuous in that the high-temperature fuel is cooled sufficiently and effectively.

(2) In the present embodiment, the communication passage 14 which allows the main fuel chamber 12 and the auxiliary fuel chamber 13 to communicate with each other is formed. Therefore, a pressure difference between the main fuel chamber 12 and the auxiliary fuel chamber 13 can cause the low-temperature fuel of the main fuel chamber 12 to flow into the auxiliary fuel chamber 13. This operation enables the fuel sealing member 44 to function favorably.

Furthermore, in the present embodiment, since the plunger 41 has the stepped shape, the volume of the auxiliary fuel chamber 13 increases when the plunger 41 ascends, thereby suctioning the fuel of the main fuel chamber 12. Therefore, the fuel of the auxiliary fuel chamber 13 can be more effectively cooled by causing the low-temperature fuel of the main fuel chamber 12 to actively flow into the auxiliary fuel chamber 13.

(3) In the present embodiment, the set of communication passage forming plates 310 (communication passage forming plates 31 and 32) which forms the communication passage between the communication passage 14 and the auxiliary fuel chamber 13, and the communication passage between the auxiliary fuel chamber 13 and the return passage 15 is disposed. This configuration can reduce the number of processing steps, as compared to a case of processing a communication groove on the drive side end surface 101, for example.

The communication passage forming plates 31 and 32 are interposed between the drive side end surface 101 of the pump body 10 and the bottom surface 452 of the upper seat 45. Therefore, it is not necessary to prepare a dedicated member for attaching the communication passage forming plate. The communication passage forming plates 31 and 32 are manufactured by means of press molding. Therefore, component costs can be reduced.

(4) In the present embodiment, the communication passage 14 is formed so as to vertically intersect the discharge valve holder attachment hole 18, and the outer wall of the discharge valve holder 81 having the discharge passage 85 internally, faces the communication passage 14. In this manner, the low-temperature fuel from the main fuel chamber 12 flows while coming into contact with the outer wall of the discharge valve holder 81. Therefore, it is possible to prevent the fuel leaking out from the contact surface of the sealing member 87 from remaining inside the discharge valve holder attachment hole 18. Accordingly, the increase in the temperature of the discharge passage 85 can be suppressed.

(5) In the present embodiment, the chamfered portions 145 and 155 are formed near an entrance of the openings 141 and 151 of the communication passage 14 and the return passage 15. The chamfered portions 145 and 155 cause the inner wall of the opening close to on the cylinder 20 to tilt in the direction away from the cylinder 20 as it goes rearward from the opening end surface. Therefore, resistance in the fuel flow from the communication passage 14 to the auxiliary fuel chamber 13 and from the auxiliary fuel chamber 13 to the return passage 15 is lessened, thereby allowing smoother flow.

Next, second to fifth embodiments of the present disclosure will be sequentially described. Any one of the respective embodiments has the return passage 15 which feeds the high-temperature fuel of the auxiliary fuel chamber 13 to the fuel cooler 96. Accordingly, effects which are the same as that of the high-pressure pump 1 according to the first embodiment can be obtained. In addition, it is assumed that any communication passage forming plate according to each embodiment is manufactured by means of press molding.

Second Embodiment

Figure 9:
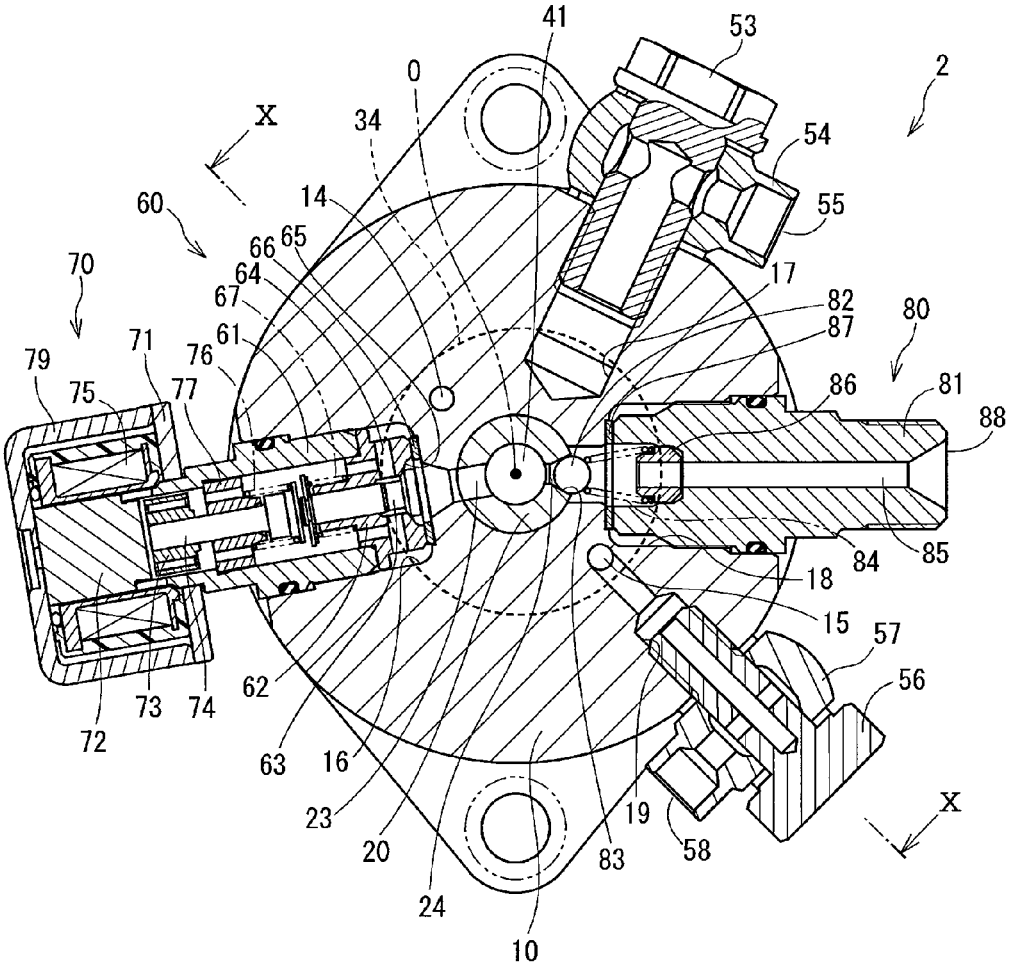
FIG. 9 is a cross-sectional view corresponding to FIG. 2 in a high-pressure pump according to a second embodiment of the present disclosure.
Figure 10:
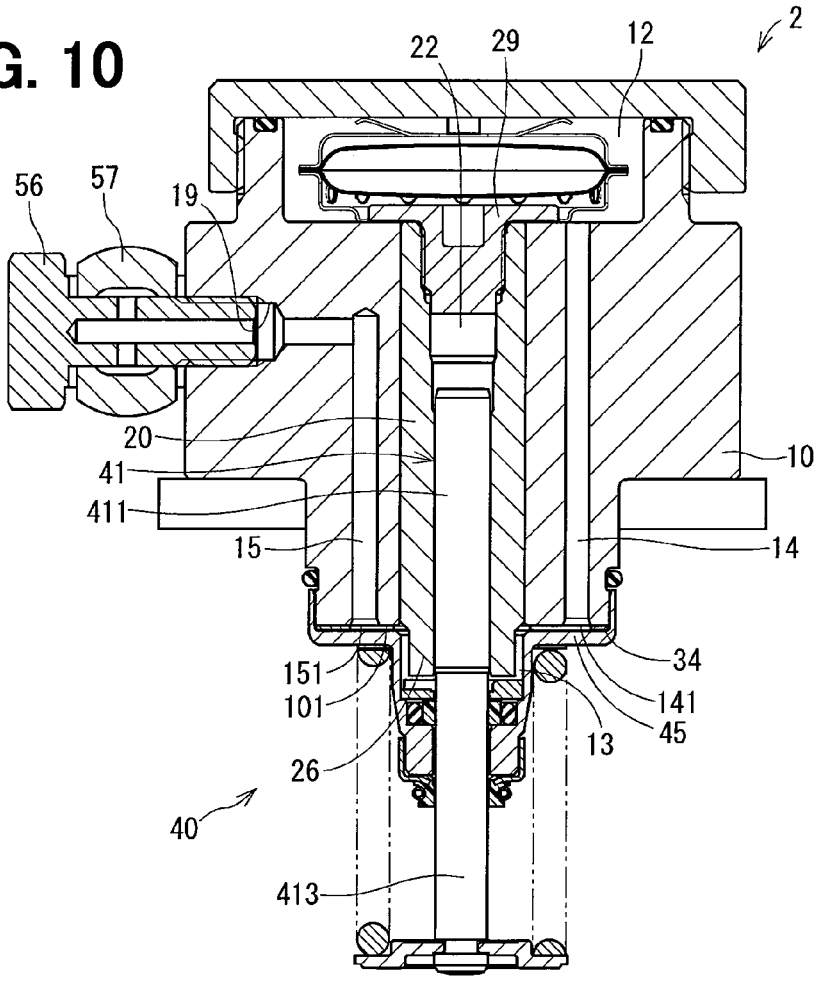
FIG. 10 is a cross-sectional view (cross-sectional view taken along line X-X in FIG. 9) corresponding to FIG. 3 in the high-pressure pump according to the second embodiment of the present disclosure.

A high-pressure pump according to the second embodiment of the present disclosure will be described with reference to FIGS. 9 to 11. FIGS. 9 and 10 respectively correspond to FIGS. 2 and 3 according to the first embodiment.

As illustrated in FIGS. 9 and 10, in a high-pressure pump 2 according to the second embodiment, a communication passage 14 is formed at a position opposite to a return passage 15 across a plunger 41, instead of a position intersecting a discharge valve holder attachment hole 18.

Figure 11:
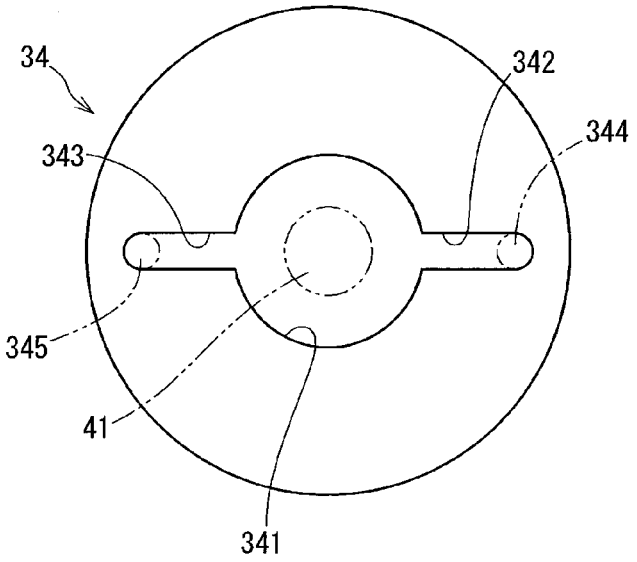
FIG. 11 is a plan view illustrating a communication passage forming plate according to the second embodiment of the present disclosure.

An example of a communication passage forming plate 34 used in the high-pressure pump 2 is illustrated in FIG. 11. The communication passage forming plate 34 has a connection-communication passage 342 which connects an opening corresponding position 344 of the communication passage 14 and a center hole 341, in a right side of the center hole 341 in FIG. 11. The communication passage forming plate 34 has a return communication passage 343 which connects an opening corresponding position 345 of the return passage 15 and the center hole 341, in a left side of the center hole 341 in FIG. 11.

According to this configuration, fuel flowing into an auxiliary fuel chamber 13 from the communication passage 14 flows toward the return passage 15 formed at the opposing position without changing a flowing direction. Therefore, resistance in the fuel flow is lessened, thereby allowing smoother flow.

Third Embodiment

A high-pressure pump according to the third embodiment of the present disclosure will be described with reference to FIGS. 12 and 13.

Figure 12:
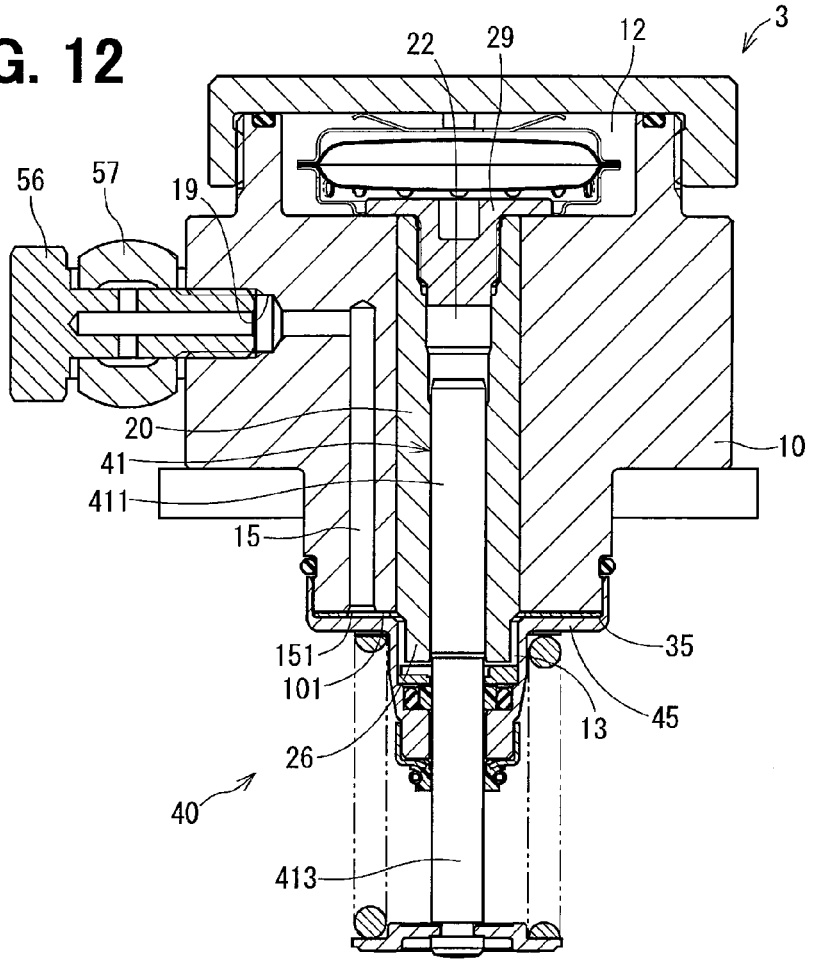
FIG. 12 is a cross-sectional view corresponding to FIG. 3 in a high-pressure pump according to a third embodiment of the present disclosure.

A high-pressure pump 3 according to the third embodiment illustrated in FIG. 12 does not have a communication passage 14 as compared to the high-pressure pump 2 according to the second embodiment illustrated in FIG. 10. According to this configuration, there is no possibility that high-temperature fuel collected in an auxiliary fuel chamber 13 may flow into a main fuel chamber 12. The fuel is only fed to a fuel cooler 96 through a return passage 15.

As described above, even when fuel pressure in the auxiliary fuel chamber 13 increases, the high-pressure pump of 3 the present disclosure can release the fuel pressure to the return passage 15. Therefore, the communication passage 14 may be eliminated.

Figure 13A:
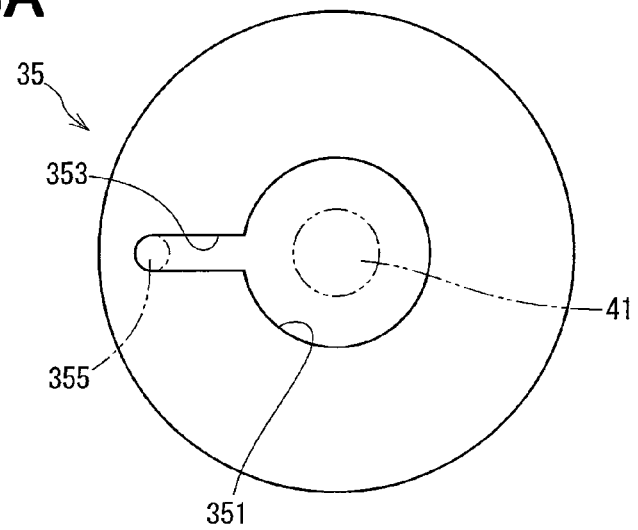
FIG. 13A is a plan view illustrating a communication passage forming plate according to the third embodiment of the present disclosure.

An example of a communication passage forming plate 35 used in the high-pressure pump 3 is illustrated in FIG. 13A. The communication passage forming plate 35 has a return communication passage 353 which connects an opening corresponding position 355 of the return passage 15 and a center hole 351, in only one direction from the center hole 351. As described above, a size of the return communication passage 353 is set to the minimum required size. Accordingly, vapor generation can be suppressed by minimizing a volume of a high-temperature fuel collecting portion.

Figure 13B:
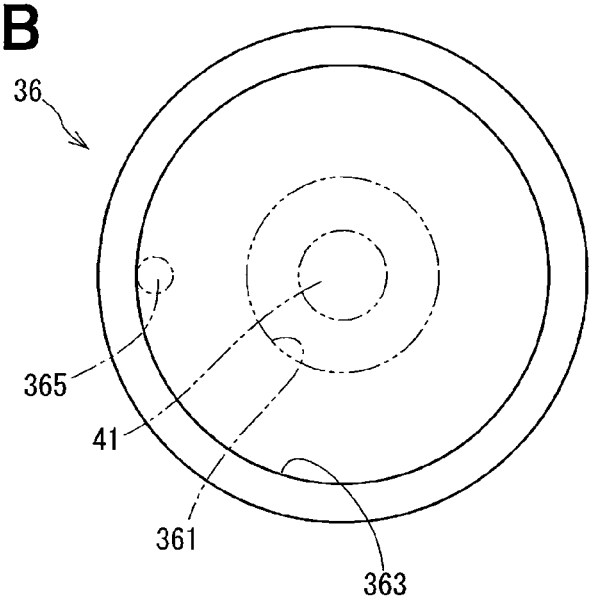
FIG. 13B is a plan view illustrating a communication passage forming plate according to a modification to the third embodiment.

Another example of a communication passage forming plate 36 used in the high-pressure pump 3 is illustrated in FIG. 13B. The communication passage forming plate 36 having a ring shape has a circular return communication passage 363 including an opening corresponding position 365 of the return passage 15, inside a ring thereof. According to this configuration, it is not necessary to perform circumferential positioning for the communication passage forming plate 36. In addition, component costs can be reduced.

Fourth Embodiment

A high-pressure pump according to the fourth embodiment of the present disclosure will be described with reference to FIG. 14.

Figure 14:
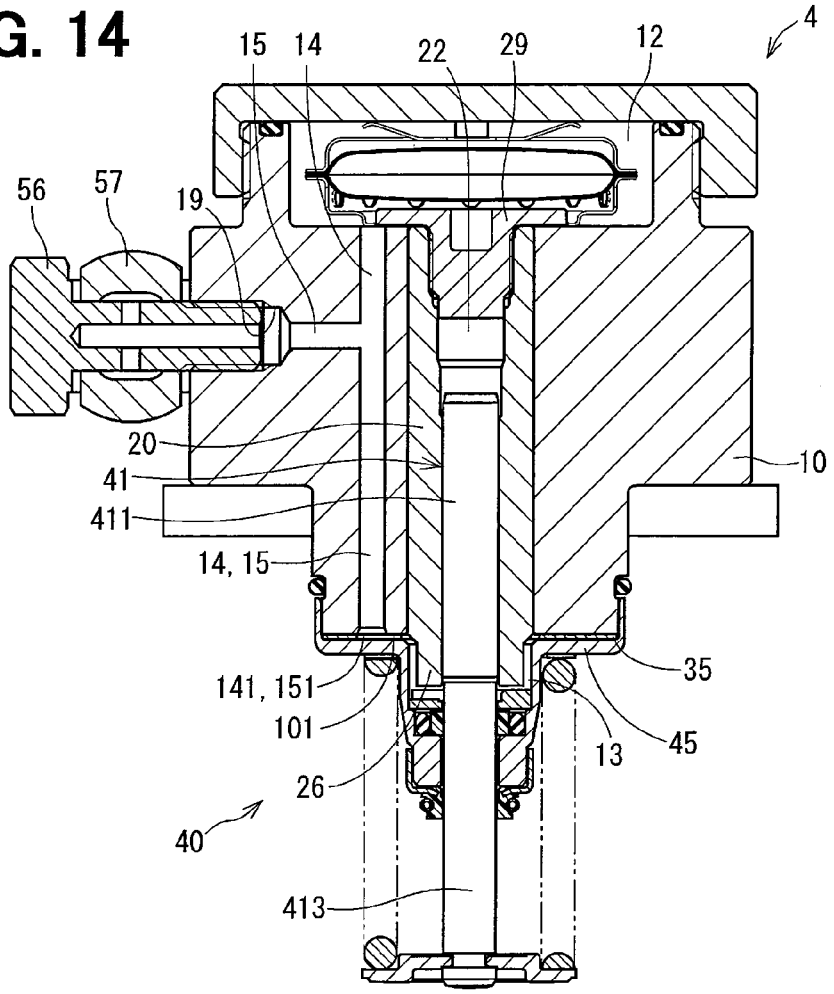
FIG. 14 is a cross-sectional view corresponding to FIG. 3 in a high-pressure pump according to a fourth embodiment of the present disclosure.

A high-pressure pump 4 according to the fourth embodiment illustrated in FIG. 14 has a communication passage 14 which branches off from an intermediate portion of a return passage 15 and is in fluid communication with a main fuel chamber 12, as compared to the high-pressure pump 3 according to the third embodiment illustrated in FIG. 12. In other words, a section from a diverging point (branching point) to an opening of a drive side end surface 101 in a T-shaped passage is shared with the communication passage 14 and the return passage 15. The high-pressure pump 4 according to this configuration can reduce the number of hole forming processes required for a pump body 10 while having the communication passage 14.

In the high-pressure pump 4 according to the fourth embodiment, a communication passage forming plate 35 or 36 used in the high-pressure pump 3 according to the third embodiment can be shared (commonly used).

Fifth Embodiment

A high-pressure pump according to the fifth embodiment of the present disclosure will be described with reference to FIG. 15.

Figure 15:
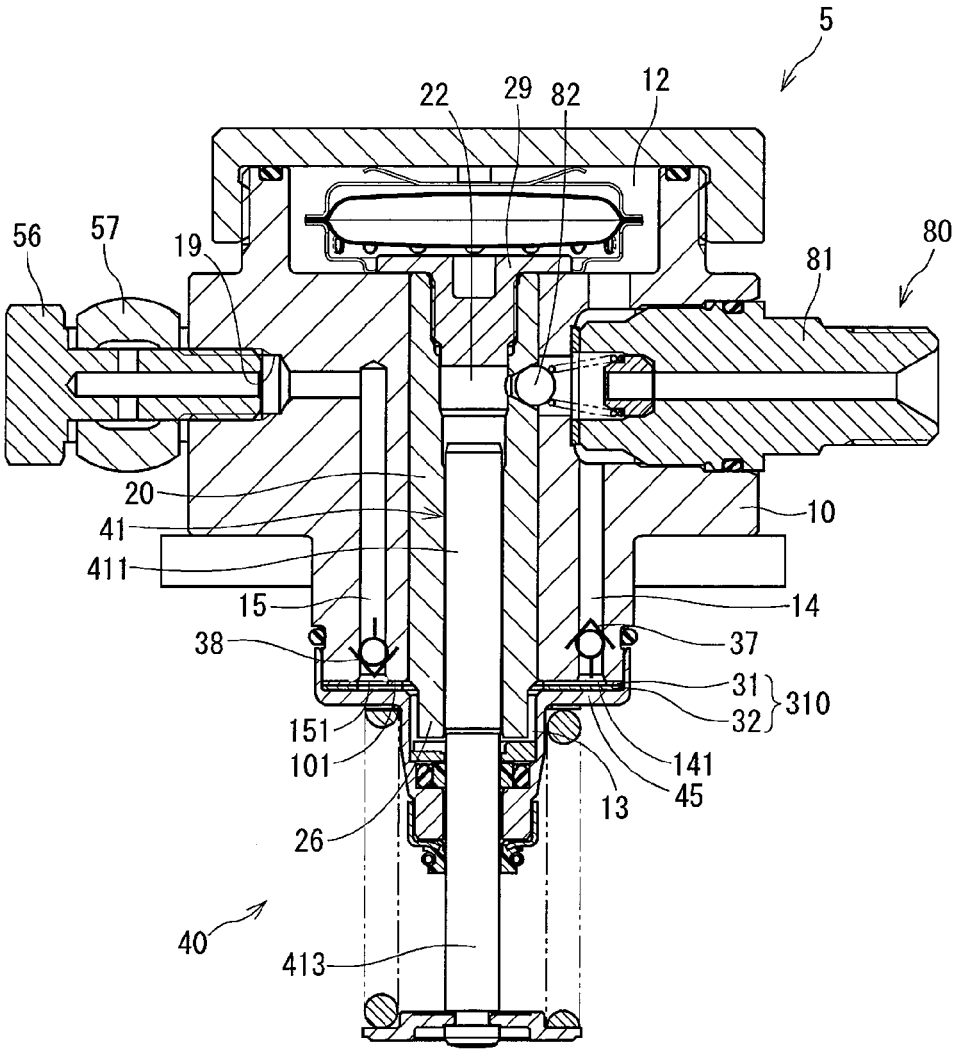
FIG. 15 is a cross-sectional view corresponding to FIG. 3 in a high-pressure pump according to a fifth embodiment of the present disclosure.

A high-pressure pump 5 according to the fifth embodiment illustrated in FIG. 15 has a first check valve 37 in a communication passage 14, and has a second check valve 38 in a return passage 15, as compared to the high-pressure pump 1 according to the first embodiment illustrated in FIG. 3.

The first check valve 37 allows fuel to flow from a main fuel chamber 12 to an auxiliary fuel chamber 13, and prevents the fuel flow from the auxiliary fuel chamber 13 to the main fuel chamber 12. The second check valve 38 allows the fuel to flow from the auxiliary fuel chamber 13 to the outside, and prevents the fuel flow from the outside to the auxiliary fuel chamber 13. A specific configuration of the first check valve 37 and the second check valve 38 may adopt a known technology in which a check valve is configured to have a ball and a spring.

This configuration regulates a fuel flow direction in the communication passage 14 and the return passage 15 so that the fuel flows in one direction. As a result, the following operations can be further added to operations of the high-pressure pump provided with the plunger 41 having a stepped shape.

During the suction stroke, descending of the plunger 41 decreases the volume of the auxiliary fuel chamber 13, and increases the pressure therein. In contrast, in the main fuel chamber 12, the pressure decreases since the fuel is suctioned to a pressurizing chamber 22 through a fuel passage 121 and a suction passage 64. A pressure difference calculated by subtracting the pressure of the communication passage 14 from the pressure of the auxiliary fuel chamber 13 increases, thereby closing the first check valve 37. Therefore, high-temperature fuel of the auxiliary fuel chamber 13 does not flow into the communication passage 14, but is discharged outward from the return passage 15 by opening the second check valve 38.

During the metering stroke, the ascending of the plunger 41 increases the volume of the auxiliary fuel chamber 13, and decreases the pressure therein. In contrast, in the main fuel chamber 12, the pressure increases since the fuel of the pressurizing chamber 22 returns to the main fuel chamber 12. Accordingly, the pressure difference calculated by subtracting the pressure of the communication passage 14 from the pressure of the auxiliary fuel chamber 13 decreases, thereby opening the first check valve 37. Therefore, low-temperature fuel of the main fuel chamber 12 flows into the auxiliary fuel chamber 13, thereby decreasing a fuel temperature in the auxiliary fuel chamber 13.

During a discharge stroke, while the plunger 41 ascends, the first check valve 37 maintains an opened state.

In response to opening and closing operations of the first check valve 37 as described above, the fuel of the main fuel chamber 12 flows into the auxiliary fuel chamber 13 through the communication passage 14, when the first check valve 37 is opened, and the fuel of the auxiliary fuel chamber 13 is discharged to the return passage 15 through the second check valve 38, when the first check valve 37 is closed.

As a result, the fuel is adapted to flow in one direction. That is, in the high-pressure pump 5, a secondary pump operation is performed in the auxiliary fuel chamber 13 in addition to a primary pump operation in the pressurizing chamber 22.

Figure 16A:
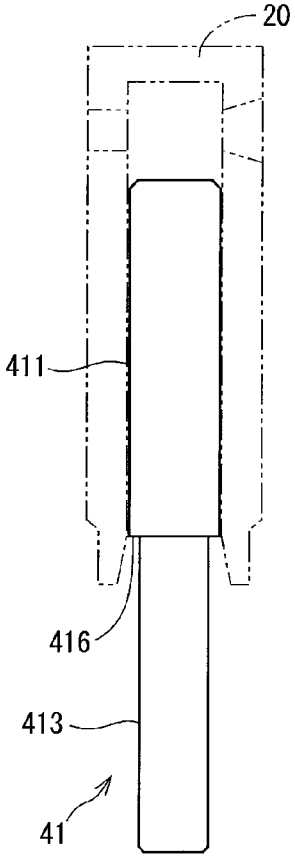
FIG. 16A is a view illustrating a plunger according to a second modification of the present disclosure.
Figure 16B:
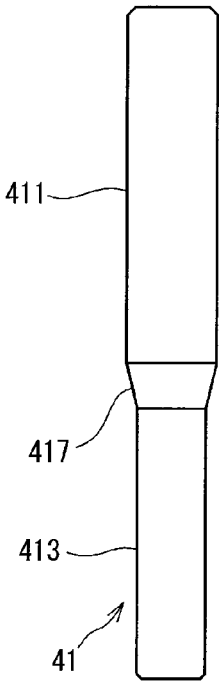
FIG. 16B is a view illustrating a plunger according to a third modification of the present disclosure.
Figure 16C:
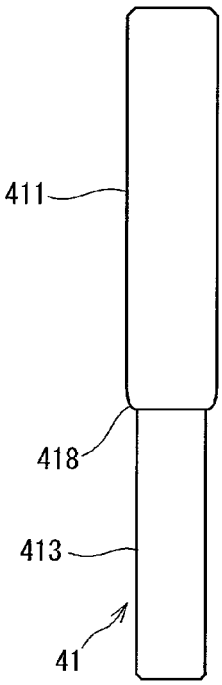
FIG. 16C is a view illustrating a plunger according to a fourth modification of the present disclosure.

Other Embodiments (1) An example of a shape of a boundary portion between a large diameter portion 411 and a small diameter portion 413 of a plunger 41 is illustrated in FIGS. 16A to 16C. The boundary portion illustrated in FIG. 16A according to a second modification is formed as a stepped portion 416 whose outer diameter is sharply changed. The boundary portion illustrated in FIG. 16B according to a third modification is formed as a tapered portion 417 whose outer diameter is gradually changed. The boundary portion illustrated in FIG. 16C according to a fourth modification is formed as an R-portion 418 having a rounded shoulder. In addition, a plunger is not limited to have a stepped shape, and may have a "stepless" shape having a constant outer diameter.

(2) In FIG. 2 according to the above-described embodiment, chamfered portions 145 and 155 are formed in an opening of a communication passage 14 and a return passage 15. In contrast, examples of a shape of the opening according to a fifth to eighth modifications are illustrated in FIGS. 17A to 17D. FIGS. 17A to 17D illustrate the examples using the reference numeral of a communication passage 14, but the same is also applied to a return passage 15. In addition, any form of the communication passage forming plate may be used. However, for reference, a reference numeral 33 (refer to FIG. 6) for a single communication passage forming plate is illustrated in parentheses.

Figure 17A:
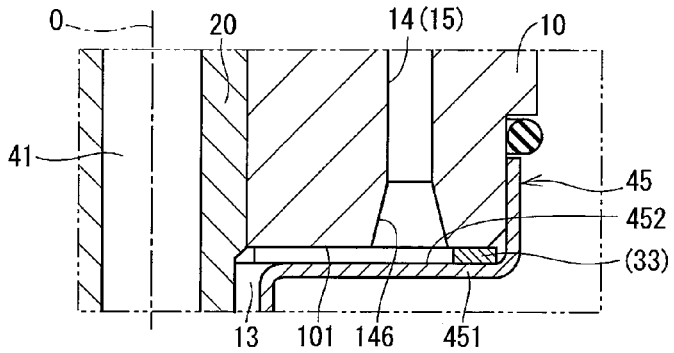
FIG. 17A is an enlarged cross-sectional view illustrating an opening portion shape in a communication passage according to a fifth modification of the present disclosure.
Figure 17B:
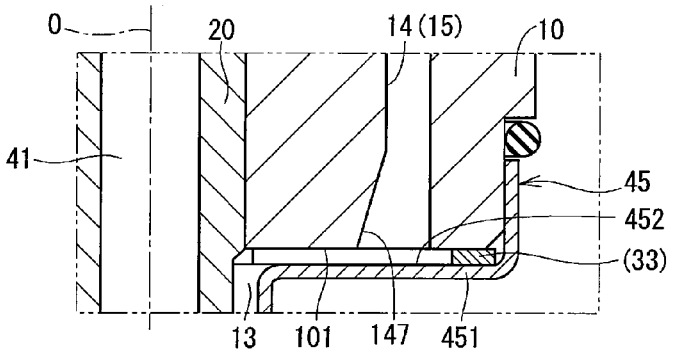
FIG. 17B is an enlarged cross-sectional view illustrating an opening portion shape in a communication passage according to a sixth modification of the present disclosure.
Figure 17C:
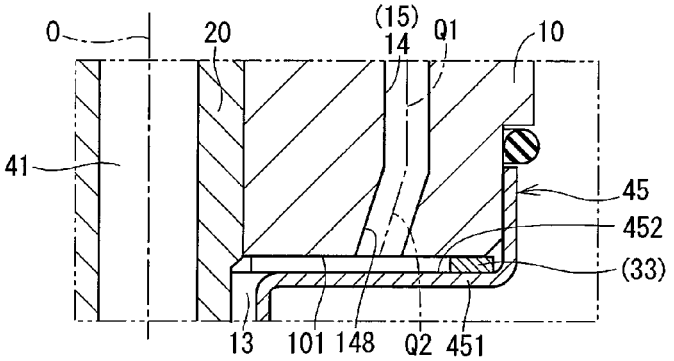
FIG. 17C is an enlarged cross-sectional view illustrating an opening portion shape in a communication passage according to a seventh modification of the present disclosure.
Figure 17D:
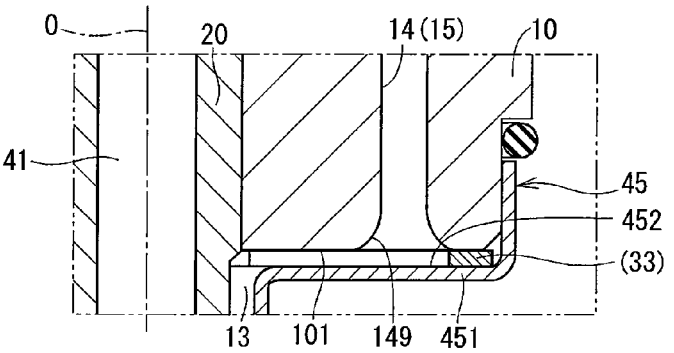
FIG. 17D is an enlarged cross-sectional view illustrating an opening portion shape in a communication passage according to an eighth modification of the present disclosure.

In the example illustrated in FIG. 17A according to the fifth modification, a tapered portion 146 expanding in a tapered shape is formed near an entrance of the communication passage 14. In the example illustrated in FIG. 17B according to the sixth modification, an inner wall 147 (tapered portion) on a side close to the cylinder 20 expands near the entrance of the communication passage 14, and an inner wall on a side opposite to the cylinder is formed to be straight. In the example illustrated in FIG. 17C according to the seventh modification, a tilting passage 148 (tapered portion) which has an axis Q2 bent with respect to an axis Q1 of the communication passage 14 is formed. In the example illustrated in FIG. 17D according to the eighth modification, an R-portion 149 (tapered portion) having a rounded corner is formed near the entrance of the communication passage 14.

In the respective examples illustrated in FIGS. 17A to 17D, any example has a common point in that "an inner wall on a cylinder side of an opening is formed so as to tilt to a side opposite to the cylinder as it goes rearward from an opening end surface", with respect to chamfered portions 145 and 155 according to the above-described embodiment. In other words, the tapered portion 146, an inner wall 147, the tilting passage 148 and the R-portion 149 may serve "a tapered portion that (i) is disposed on a side of an inner wall that is closer to a cylinder, (ii) defines a portion of an opening of a communication passage (or a return passage) and (iii) tapers from the opening of the communication passage (or the return passage) in the direction away from the cylinder". Therefore, resistance in fuel flow is lessened, thereby allowing smoother flow.

(3) A "bottom cover member" interposing the communication passage forming plates 31 and 32 between the bottom cover member and a drive side end surface 101 of a pump body 10 is not limited to an example in which the bottom cover member is configured to have the flange portion 451 of the upper seat 45 as in the above-described embodiment, and the bottom cover member may be configured to have other dedicated members.

(4) A method of manufacturing the communication passage forming plates 31 and 32 is not limited to press molding, and the communication passage forming plates 31 and 32 may be manufactured using a method of cutting work. In addition, without disposing the communication passage forming plate, a communication groove may be formed on the drive side end surface 101, for example, to communicate the auxiliary fuel chamber 13 with the communication passage 14, or to communicate the auxiliary fuel chamber 13 with the return passage 15.

(5) In contrast to the above-described fifth embodiment, a configuration may be adopted which includes either a first check valve 37 or a second check valve 38.

(6) A cylinder which houses a plunger so as to be reciprocally movable is not limited to the above-described example in which the cylinder 20 is separately inserted into the pump body 10, and the cylinder may be directly formed in a pump body.

(7) Configurations of each portion in the high-pressure pump other than configurations relating to the return passage 15, the communication passage 14 or the communication passage forming plates 31 and 32 are not limited to the above-described embodiments. For example, a pulsation damper 50 may not be disposed in the main fuel chamber 12. A suction valve 63 may be a normally closed type, instead of the normally opened type as in the above-described embodiments.

Hitherto, the present disclosure is not limited to the embodiments, and may be modified in various ways within a scope not departing from the gist of the disclosure.

What is claimed is:

1. A high-pressure pump comprising:

a plunger;

a cylinder slidably housing the plunger therein;

a pressurizing chamber formed inside the cylinder, fuel being pressurized inside the pressurizing chamber by sliding movement of the plunger;

a pump body housing the cylinder and having an end surface on an opposite side of the pump body relative to the pressurizing chamber in an axial direction;

a main fuel chamber disposed inside the pump body into which fuel is supplied from a fuel inlet that is upstream of the pressurizing chamber;

an auxiliary fuel chamber having a side defined by one end of the cylinder on an opposite side of the cylinder relative to the pressurizing chamber;

a return passage disposed inside the pump body and having an opening disposed on the end surface of the pump body, the return passage being in fluid communication with an external cooling unit;

a communication passage disposed inside the pump body and fluidly connecting the main fuel chamber and the auxiliary fuel chamber; and a first check valve disposed in the communication passage, the first check valve allowing fuel flow from the main fuel chamber to the auxiliary fuel chamber, and prohibiting fuel flow from the auxiliary fuel chamber to the main fuel chamber, wherein fuel leaking out from the pressurizing chamber through a clearance between the cylinder and the plunger is collected inside the auxiliary fuel chamber, and the fuel collected inside the auxiliary fuel chamber flows toward the external cooling unit through the return passage.

2. The high-pressure pump according to claim 1, wherein the return passage and the communication passage are circumferentially separated from each other.

3. The high-pressure pump according to claim 2, wherein the return passage and the communication passage are positioned opposite to each other across the plunger.

4. The high-pressure pump according to claim 1, wherein the communication passage branches off from an intermediate portion of the return passage.

5. The high-pressure pump according to claim 1, further comprising a discharge passage member having a discharge passage therein through which the fuel pressurized in the pressurizing chamber is discharged, wherein the discharge passage member has a portion of an outer wall positioned inside the communication passage.

6. The high-pressure pump according to claim 1, further comprising a second check valve disposed in the return passage, the second check valve allowing fuel flow from the auxiliary chamber to an outside of the pump body, and prohibiting fuel flow from the outside to the auxiliary fuel chamber.

7. The high-pressure pump according to claim 1, wherein the plunger has (i) a large diameter portion that defines a side of the pressurizing chamber and slides in the axial direction along an inner wall of the cylinder, and (ii) a small diameter portion on an opposite side of the plunger relative to the pressurizing chamber in the axial direction.

8. The high-pressure pump according to claim 1, wherein the communication passage has an inner wall and an opening on the end surface of the pump body, the inner wall of the communication passage has a tapered portion disposed on a side of the inner wall that is closer to the cylinder, the tapered portion defining a portion of the opening of the communication passage, and the tapered portion tapers from the opening of the communication passage in a direction away from the cylinder.

9. The high-pressure pump according to claim 1, wherein the return passage has an inner wall, the inner wall of the return passage has a tapered portion disposed on a side of the inner wall that is closer to the cylinder, the tapered portion defining a portion of the opening of the return passage, and the tapered portion tapers from the opening of the return passage in a direction away from the cylinder.

10. A high-pressure pump comprising:

a plunger;

a cylinder slidably housing the plunger therein;

a pressurizing chamber formed inside the cylinder, fuel being pressurized inside the pressurizing chamber by sliding movement of the plunger;

a pump body housing the cylinder and having an end surface on an opposite side of the pump body relative to the pressurizing chamber in an axial direction;

a main fuel chamber disposed inside the pump body into which fuel is supplied from a fuel inlet that is upstream of the pressurizing chamber;

an auxiliary fuel chamber having a side defined by one end of the cylinder on an opposite side of the cylinder relative to the pressurizing chamber;

a return passage disposed inside the pump body and having an opening disposed on the end surface of the pump body, the return passage being in fluid communication with an external cooling unit;

a bottom cover member fixed to the pump body and having a bottom surface that is opposite to the end surface of the pump body, and a communication passage forming plate that is interposed between the end surface of the pump body and the bottom cover member, wherein fuel leaking out from the pressurizing chamber through a clearance between the cylinder and the plunger is collected inside the auxiliary fuel chamber, the fuel collected inside the auxiliary fuel chamber flows toward the external cooling unit through the return passage, and the communication passage forming plate has a return communication passage therein that fluidly communicates the auxiliary fuel chamber with the return passage in a radial direction.

11. A high-pressure pump comprising:

a plunger;

a cylinder slidably housing the plunger therein;

a pressurizing chamber formed inside the cylinder, fuel being pressurized inside the pressurizing chamber by sliding movement of the plunger;

a pump body housing the cylinder and having an end surface on an opposite side of the pump body relative to the pressurizing chamber in an axial direction;

a main fuel chamber disposed inside the pump body into which fuel is supplied from a fuel inlet that is upstream of the pressurizing chamber;

an auxiliary fuel chamber having a side defined by one end of the cylinder on an opposite side of the cylinder relative to the pressurizing chamber;

a return passage disposed inside the pump body and having an opening disposed on the end surface of the pump body, the return passage being in fluid communication with an external cooling unit;

a communication passage disposed inside the pump body and fluidly connecting the main fuel chamber and the auxiliary fuel chamber;

a bottom cover member fixed to the pump body and having a bottom surface that is opposite to the end surface of the pump body, and a communication passage forming plate that is interposed between the end surface of the pump body and the bottom cover member, wherein fuel leaking out from the pressurizing chamber through a clearance between the cylinder and the plunger is collected inside the auxiliary fuel chamber, and the fuel collected inside the auxiliary fuel chamber flows toward the external cooling unit through the return passage, and the communication passage forming plate has a connection communication passage therein that fluidly communicates the auxiliary fuel chamber with the communication passage in a radial direction.

* * * * *